US009840850B2

(12) United States Patent
Teng

(10) Patent No.: US 9,840,850 B2
(45) Date of Patent: Dec. 12, 2017

(54) TILE LEVELER

(71) Applicant: Ching-Tien Teng, Taichung (TW)

(72) Inventor: Ching-Tien Teng, Taichung (TW)

( * ) Notice: Subject to any disclaimer, the term of this patent is extended or adjusted under 35 U.S.C. 154(b) by 0 days.

(21) Appl. No.: 15/340,446

(22) Filed: Nov. 1, 2016

(65) Prior Publication Data

US 2017/0211282 A1 Jul. 27, 2017

(30) Foreign Application Priority Data

Jan. 22, 2016 (TW) ..... 105102133 A

(51) Int. Cl.
*E04F 21/20* (2006.01)

(52) U.S. Cl.
CPC ..... *E04F 21/20* (2013.01)

(58) Field of Classification Search
CPC ..... E04F 13/0892; E04F 13/02005; E04F 13/02022; E04F 21/20; E04F 21/22; E04F 21/1894; E04F 21/1877; E04F 21/1838; E04F 21/165
See application file for complete search history.

(56) References Cited

U.S. PATENT DOCUMENTS

| | | | | |
|---|---|---|---|---|
| 9,260,872 | B2 * | 2/2016 | Bunch | E04F 21/0092 |
| 2011/0138737 | A1 * | 6/2011 | Edgerly | E04F 21/22 52/745.05 |
| 2014/0027082 | A1 * | 1/2014 | Stebbing | B22D 27/08 164/71.1 |
| 2014/0116001 | A1 * | 5/2014 | Ghelfi | E04F 21/0092 52/749.11 |

* cited by examiner

*Primary Examiner* — Jessica Laux
(74) *Attorney, Agent, or Firm* — Alan D. Kamrath; Kamrath IP Lawfirm, P.A.

(57) ABSTRACT

A tile leveler contains: a pressing base, a rotation block, and a pulling member. The pressing base includes at least one first plate and two second plates. Among a central portion of the at least one first plate and the two second plates is defined an elongated orifice. Two ribs are fixed beside two sides of the elongated orifice, and the two second plates has two U-shaped notches respectively. The rotation block is fixed between and connected with the two second plates, and the rotation block includes two coupling shafts, an accommodation chamber, and multiple recesses corresponding to the two ribs. The pulling member includes a head segment, an extension, and an action segment. A part of the head segment is retained in the accommodation chamber, the extension extends out of the cutout, and the action segment extends through the elongated orifice.

8 Claims, 6 Drawing Sheets

TILE LEVELER

BACKGROUND OF THE INVENTION

Field of the Invention

The present invention relates to a tile leveler and, more particularly, to the tile leveler which is capable of adjusting a flatness of multiple tiles after the multiple tiles are fixed.

Description of the Prior Art

Tiles are fixed on a construction site by workers by using hand tools, and the workers observe whether the tiles are fixed flatly and consistently, thus taking a long time to fix the tiles. Furthermore, when the tiles are not fixed flatly and consistently, it is easy to cause poor appearance, water accumulation, tripping or other dangers.

To overcome the above-mentioned problems, conventional tile levelers have been developed. However, they cannot be applicable for various tiles with different thicknesses and cannot be used repeatedly.

The present invention has arisen to mitigate and/or obviate the afore-described disadvantages.

SUMMARY OF THE INVENTION

The primary objective of the present invention is to provide a tile leveler which is capable of adjusting a flatness of any two adjacent tiles, after multiple tiles are fixed.

Another objective of the present invention is to provide a tile leveler which clamps peripheral sides of two adjacent tiles by using at least one first plate of a pressing base and an action segment of a pulling member, so that tops and bottoms of the two adjacent tiles are flush with each other, thus adjusting the flatness of the multiple tiles easily and quickly.

A tile leveler provided by the present invention contains: a pressing base, a rotation block, and a pulling member.

The pressing base includes at least one first plate and two second plates perpendicular to the at least one first plate. Among a central portion of the at least one first plate and the two second plates is defined an elongated orifice. Two ribs are fixed beside two sides of the elongated orifice, and the two second plates have two U-shaped notches defined on two upper ends thereof, respectively.

A first end of the rotation block is fixed between and is in connection with the two second plates of the pressing base. The rotation block includes two coupling shafts extending outwardly from two sides of the first end of the rotation block and retained in the two U-shaped notches of the two second plates, respectively. The rotation block also includes an accommodation chamber defined therein and between the two coupling shafts. The accommodation chamber has a cutout formed thereon. The rotation block further includes multiple recesses arranged opposite to the accommodation chamber and corresponding to the two ribs.

The pulling member includes a head segment, an extension, and an action segment which are one-piece formed. A part of the head segment is retained in the accommodation chamber of the rotation block. The extension extends out of the cutout of the accommodation chamber, and the action segment extends through the elongated orifice of the pressing base.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
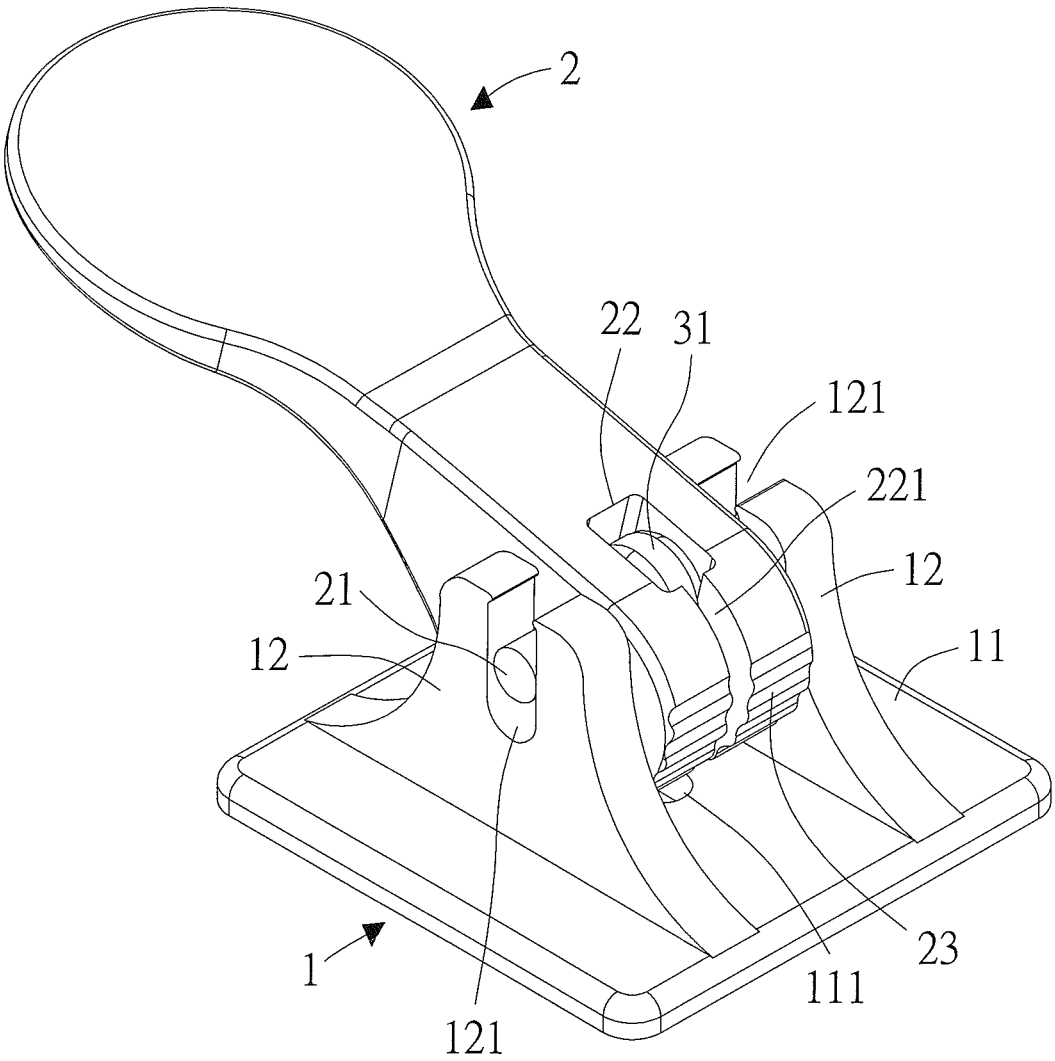
FIG. 1 is a perspective view showing the assembly of a tile leveler in accordance with a preferred embodiment of the present invention.
Figure 2:
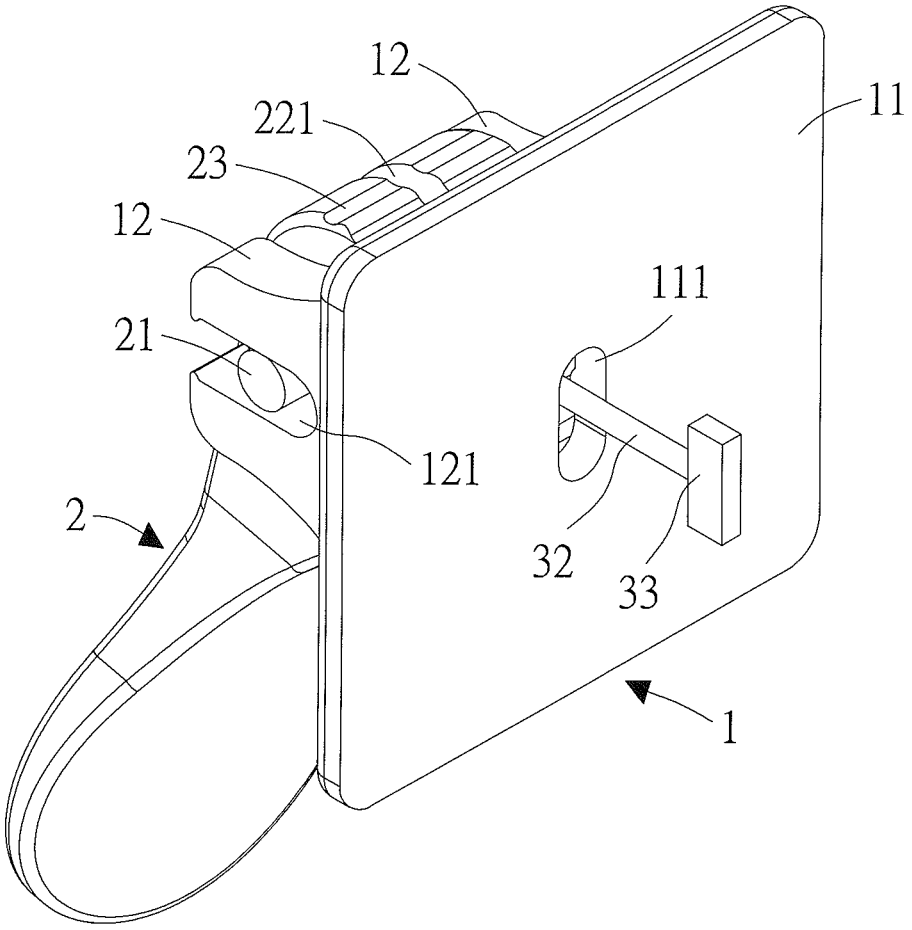
FIG. 2 is another perspective view showing the assembly of the tile leveler in accordance with the preferred embodiment of the present invention.

Referring to FIGS. 1 and 2, a tile leveler according to a preferred embodiment of the present invention comprises: a pressing base 1, a rotation block 2, and a pulling member 3.

Figure 3:
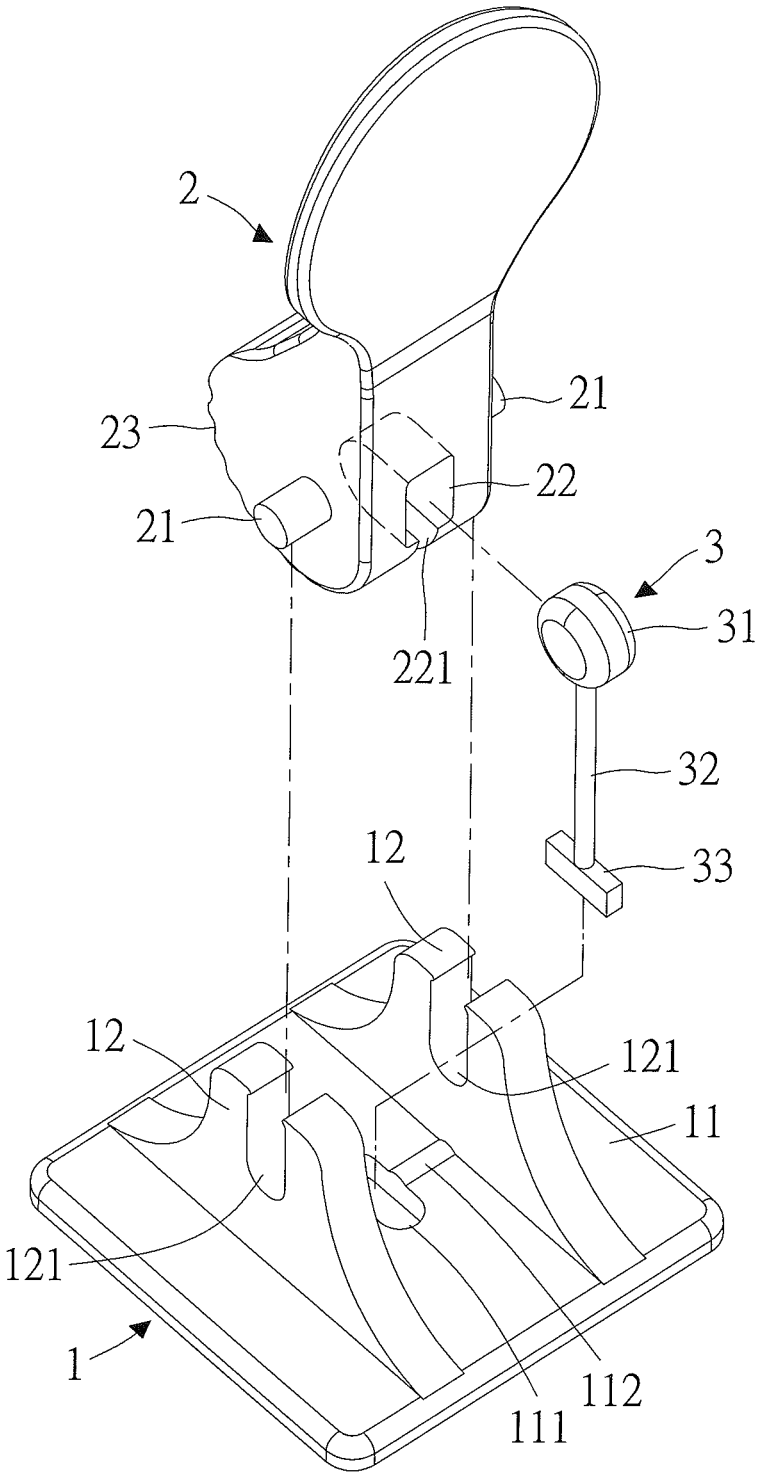
FIG. 3 is a perspective view showing the exploded components of the tile leveler in accordance with the preferred embodiment of the present invention.

The pressing base 1 includes at least one first plate 11 in a rectangular shape and two second plates 12 perpendicular to the at least one first plate 11. The two second plates 12 are parallel to and are separated from each other. Among a central portion of the at least one first plate 11 and the two second plates 12 is defined an elongated orifice 111 in a racetrack shape. Two ribs 112 are fixed beside two sides of the elongated orifice 111 (as shown in FIG. 3). The two second plates 12 have two U-shaped notches 121 defined on two upper ends thereof, respectively.

Figure 5:
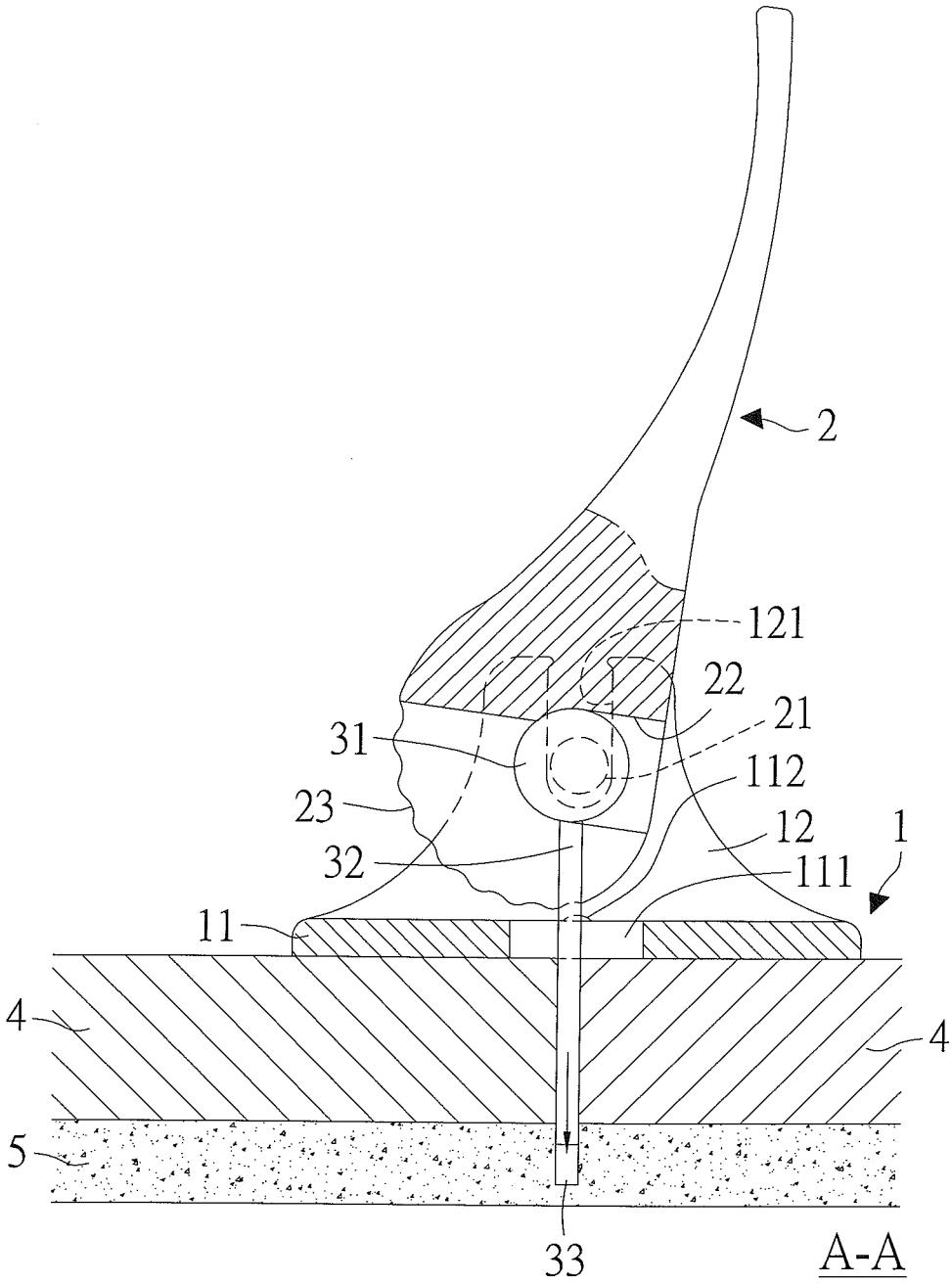
FIG. 5 is a cross sectional view taken along the line A-A of FIG. 4.
Figure 6:
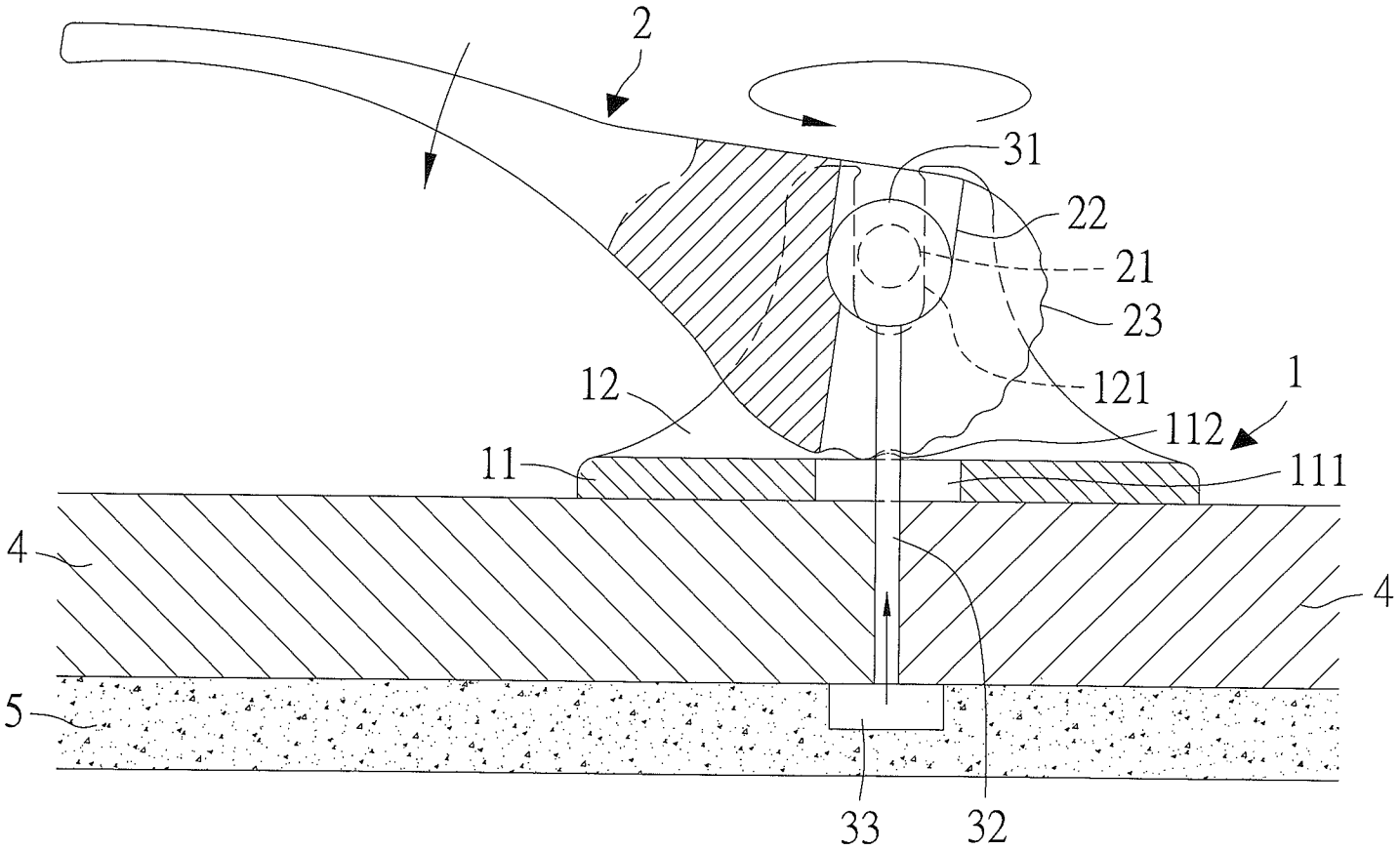
FIG. 6 is another cross sectional view showing the operation of the tile leveler in accordance with the preferred embodiment of the present invention.

A first end of the rotation block 2 is fixed between and is in connection with the two second plates 12 of the pressing base 1. The rotation block 2 includes two coupling shafts 21 extending outwardly from two sides of the first end of the rotation block 2 and retained in the two U-shaped notches 121 of the two second plates 12, respectively. The rotation block 2 also includes an accommodation chamber 22 defined therein and between the two coupling shafts 21, and the accommodation chamber 22 has a cutout 221 formed thereon. The rotation block 2 further includes multiple recesses 23 arranged opposite to the accommodation chamber 22 and corresponding to the two ribs 112 (as illustrated in FIGS. 5 and 6). One end of the rotation block 2, on which the two coupling shafts 21, the accommodation chamber 22, and the multiple recesses 23 are arranged, is elliptical, and a part of the one end of the rotation block 2 below the accommodation chamber 22 is semicircular.

The pulling member 3 includes a head segment 31, an extension 32, and an action segment 33 which are one-piece formed. A part of the head segment 31 is circular and is retained in the accommodation chamber 22 of the rotation block 2, the extension 32 extends out of the cutout 221 of the accommodation chamber 22, and the action segment 33 is rectangular and extends through the elongated orifice 111 of the pressing base 1. A thickness of the head segment 31 is less than a width of the elongated orifice 111.

Figure 4:
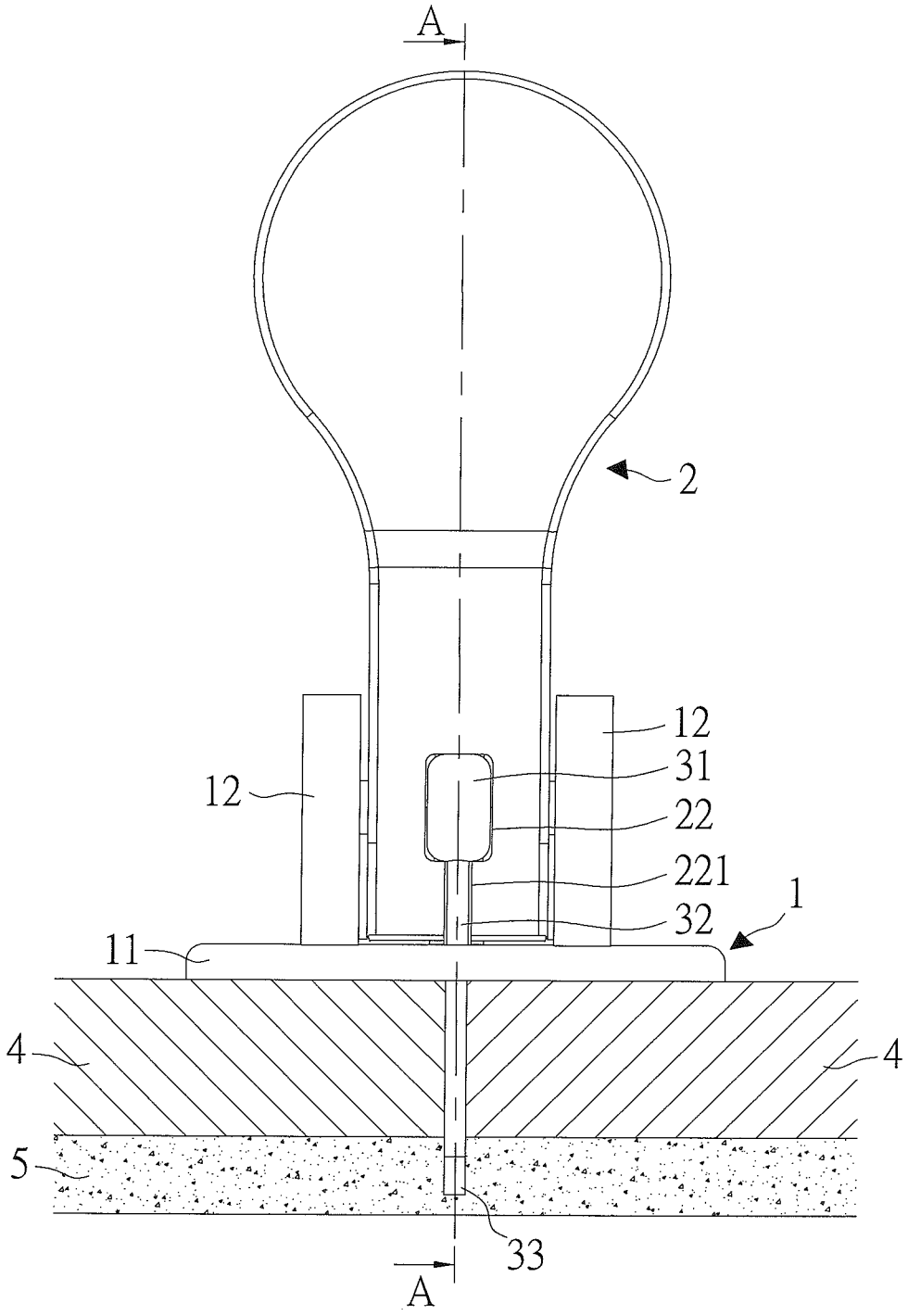
FIG. 4 is a cross sectional view showing the operation of the tile leveler in accordance with the preferred embodiment of the present invention.

Referring to FIGS. 4 and 5, when desiring to adjust a flatness of multiple tiles 4 fixed on a cement surface 5 (which is not solidified), the first end of the rotation block 2 and the action segment 33 of the pulling member 3 are inserted into a gap between any two adjacent tiles 4, and the action segment 33 of the pulling member 3 extends into the cement surface 5 under the two adjacent tiles 4 (in the meantime, two long sides of the action segment 33 are parallel to peripheral sides of the any two adjacent tiles 4). Thereafter, the pressing base 1, the rotation block 2, and the pulling member 3 are rotated 90 degrees (as shown in FIG. 6), so that the two long sides of the action segment 33 are perpendicular to the peripheral sides of the two adjacent tiles 4. The multiple recesses 23 engage with the two ribs 112, and the rotation block 2 is pressed by rotating the two coupling shafts 21 along the two U-shaped notches 121. Hence the pulling member 3 is driven by the rotation block 2 to lift upwardly until the action segment 33 retains under the two adjacent tiles 4, and tops and bottoms of the two adjacent tiles 4 are forced by the at least one first plate 11 and the action segment 33, thus adjusting the flatness of the multiple tiles.

After the multiple tiles 4 are fixed and the cement surface 5 is solidified, the rotation member 2 is upwardly rotated 180 degrees and is lifted by rotating the two coupling shafts 21 along the two U-shaped notches 121. Then, the rotation block 2 is removed from the pulling member 3 and the pressing base 1, the pulling member 3 is separated from the pressing base 1, and the pulling member 3 between the two adjacent tiles 4 is cut, thus fixing the multiple tiles 4 and adjusting their flatness.

Accordingly, only the pulling member 3 is consumed as fixing the multiple tiles 4, and the pressing base 1 and the rotation block 2 are used repeatedly.

Preferably, adhesive adheres to the cement surface 5 and the multiple tiles 4 securely, and the two adjacent tiles 4 are fixed consistently and quickly.

While various embodiments in accordance with the present invention have been shown and described, it is clear to those skilled in the art that further embodiments may be made without departing from the scope of the present invention.

What is claimed is:

1. A tile leveler comprising:

a pressing base including at least one first plate and two second plates perpendicular to the at least one first plate, wherein among a central portion of the at least one first plate and the two second plates is defined an elongated orifice, two ribs being fixed beside two sides of the elongated orifice and between the two second plates, with the two second plates having two U-shaped notches defined on two upper ends thereof opposite to the at least one first plate, respectively;

a rotation block has a first end between the two second plates of the pressing base, with the rotation block including two coupling shafts extending axially outwardly from two sides of the first end of the rotation block and rotatable retained in the two U-shaped notches of the two second plates, respectively, generally parallel to and spaced from the at least one first plate, with the rotation block also including an accommodation chamber defined therein and between the two coupling shafts, with the accommodation chamber having a cutout formed thereon, with the rotation block further including multiple recesses arranged circumferentially on a periphery opposite to the accommodation chamber, with the rotation block rotatable about the two coupling shafts relative to the pressing base with one of the multiple recesses corresponding to the two ribs according to a rotational position of the rotation block; and a pulling member including a head segment, an extension, and an action segment which are one-piece formed, wherein a part of the head segment is retained in the accommodation chamber of the rotation block, the extension extends out of the cutout of the accommodation chamber, and the action segment extends through the elongated orifice of the pressing base.

2. The tile leveler as claimed in claim 1, wherein the at least one first plate is in a rectangular shape.

3. The tile leveler as claimed in claim 1, wherein the elongated orifice is in a racetrack shape.

4. The tile leveler as claimed in claim 1, wherein the two second plates are parallel and are separated from each other.

5. The tile leveler as claimed in claim 1, wherein the first end of the rotation block, on which the two coupling shafts, the accommodation chamber, and the multiple recesses are arranged, is elliptical.

6. The tile leveler as claimed in claim 1, wherein the action segment is rectangular.

7. The tile leveler as claimed in claim 1, wherein a part of the first end of the rotation block below the accommodation chamber is semicircular, and wherein a part of the head segment, retaining in the accommodation chamber of the rotation block, is circular.

8. The tile leveler as claimed in claim 1, wherein a thickness of the head segment is less than a width of the elongated orifice.

* * * * *